US009469113B2

(12) United States Patent
Kawashima

(10) Patent No.: US 9,469,113 B2
(45) Date of Patent: Oct. 18, 2016

(54) METHOD OF INTRODUCING INK AND INKJET RECORDING APPARATUS

(71) Applicant: KYOCERA Document Solutions Inc., Osaka (JP)

(72) Inventor: Naoko Kawashima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/865,978

(22) Filed: Sep. 25, 2015

(65) Prior Publication Data

US 2016/0089889 A1 Mar. 31, 2016

(30) Foreign Application Priority Data

Sep. 26, 2014 (JP) ..... 2014-196513

(51) Int. Cl.
*B41J 2/17* (2006.01)
*B41J 2/165* (2006.01)

(52) U.S. Cl.
CPC ..... *B41J 2/1707* (2013.01); *B41J 2/1652* (2013.01); *B41J 2/16552* (2013.01); *B41J 2002/16597* (2013.01)

(58) Field of Classification Search
CPC ..... B41J 2/1707; B41J 2002/16597; B41J 2/16552; B41J 2/1652
See application file for complete search history.

(56) References Cited

U.S. PATENT DOCUMENTS 6,260,944 B1 * 7/2001 Mochizuki ..... B41J 2/16538 347/33
2004/0070651 A1 * 4/2004 Usui ..... B41J 2/1652 347/84
2007/0085884 A1 * 4/2007 Shindo ..... B41J 2/17533 347/86
2007/0137519 A1 * 6/2007 Sugimoto ..... B41J 2/16552 106/31.13
2012/0004385 A1 * 1/2012 Kodama ..... B82Y 10/00 526/320
2015/0042723 A1 * 2/2015 Fukuda ..... B41J 2/14274 347/47

FOREIGN PATENT DOCUMENTS

JP 2012-187904 A 10/2012

* cited by examiner

*Primary Examiner* — Manish S Shah
*Assistant Examiner* — Yaovi M Ameh
(74) *Attorney, Agent, or Firm* — Studebaker & Brackett PC

(57) ABSTRACT

A replacement assisting liquid having a lower specific weight than an ink is introduced into a recording head filled with a preservative solution containing at least a moisturizing agent to discharge the preservative solution out of the recording head. Next, the ink is introduced into the recording head to discharge the replacement assisting liquid out of the recording head.

10 Claims, 6 Drawing Sheets

METHOD OF INTRODUCING INK AND INKJET RECORDING APPARATUS

INCORPORATION BY REFERENCE

The present application claims priority under 35 U.S.C. §119 to Japanese Patent Application No. 2014-196513, filed on Sep. 26, 2014. The contents of this application are incorporated herein by reference in their entirety.

BACKGROUND

The present disclosure relates to an ink introduction method of introducing an ink into an inkjet recording head and an inkjet recording apparatus.

In the case where an inkjet recording apparatus or a recording head to be mounted in an inkjet recording apparatus is transported from a production site such as a factory with a flow channel within the recording head filled with an ink, the ink may deteriorate before the inkjet recording apparatus or the recording head is delivered to a user. Deterioration of an ink may hinder recording of a satisfactory image on a recording medium such as paper.

In the case where an inkjet recording apparatus or a recording head is transported with a flow channel within the recording head empty, an ink will for example be introduced into the flow channel within the recording head after the inkjet recording apparatus or the recording head is delivered to a user. In this case, however, the flow channel within the recording head is dry at the time of the ink introduction. In the dry flow channel, the ink shows poor wetting and spreading characteristics and tends to generate air bubbles therein. Air bubbles generated in the ink loaded in the flow channel within the recording head may hinder recording of a satisfactory image on a recording medium such as paper. The generation of air bubbles tends to occur particularly in a piezoelectric inkjet recording head.

When an ink is introduced into an empty recording head, therefore, an evacuation process to evacuate air bubbles is needed in the ink introduction. The need brings a concern that the time required for the ink introduction is increased by the time required for the evacuation process.

It is therefore desirable that prior to transportation of an inkjet recording apparatus or a recording head, a flow channel within the recording head is filled with a coloring material-free preservative solution. More specifically, the inkjet recording apparatus or the recording head is transported from a production site with the flow channel within the recording head filled with the preservative solution. The preservative solution in the recording head is replaced with an ink after the inkjet recording apparatus or the recording head is delivered to a seller or a user.

The preservative solution is required to have the following three functions.

(1) Introduction and diffusion facilitating function: A function of facilitating the ink to show good wetting and spreading characteristics in the flow channel within the recording head and facilitating the ink to diffuse well in the preservative solution in introduction of the ink into the recording head and replacement of the preservative solution in the recording head with the ink (2) Aggregation preventing function: A function of preventing aggregation of a coloring component in the ink such as a pigment in introduction of the ink into the recording head and replacement of the preservative solution in the recording head with the ink (3) Antifreezing function: A function of preventing freezing of the preservative solution Of the three functions, the antifreezing function works to prevent a fine structure or a fine feature of a recording head, such as a flow channel having a fine step and a fine gap, from being damaged in a low-temperature environment. If a preservative solution that does not have the antifreezing function is loaded in a recording head, an aqueous component in the preservative solution may freeze and expand in a low-temperature environment and cause damage of a flow channel within the recording head. In the case of a piezoelectric inkjet recording head, the piezoelectric element thereof may be damaged. The antifreezing function contributes to prevention of damage of the fine structure or the fine feature due to a low-temperature environment. The antifreezing function is therefore particularly necessary in colder climates.

In order to impart the antifreezing function to the preservative solution, it is necessary to include a large amount of moisturizing agent in the preservative solution. The moisturizing agent has a relatively high specific weight. Inclusion of a large amount of moisturizing agent in the preservative solution therefore results in the preservative solution having a higher specific weight than the ink. Consequently, the ink is less diffusive in the preservative solution. In other words, the preservative solution has poor introduction and diffusion facilitating function. Having poor introduction and diffusion facilitating function, the preservative solution cannot facilitate ink introduction into a recording head. It is therefore difficult for the preservative solution to have both the antifreezing function and the introduction and diffusion facilitating function. The time required to replace the preservative solution with the ink increases with decreasing in the diffusivity of the ink in the preservative solution. As a result, the ink is more likely to generate air bubbles. Another concern is that the preservative solution may remain in the flow channel within the recording head for a long period of time.

SUMMARY

An ink introduction method according to the present disclosure is a method of introducing an ink into a recording head using a preservative solution and a replacement assisting liquid. The preservative solution contains at least a moisturizing agent. The replacement assisting liquid has a lower specific weight than the ink. The ink introduction method according to the present disclosure includes: introducing the replacement assisting liquid into the recording head filled with the preservative solution to discharge the preservative solution out of the recording head; and introducing the ink into the recording head to discharge the replacement assisting liquid out of the recording head.

An inkjet recording apparatus according to the present disclosure includes a first flow channel, a second flow channel, a pumping mechanism, a switching valve, a recording head, and a third flow channel. The first flow channel is connected with a first tank containing a replacement assisting liquid. The second flow channel is connected with a second tank containing an ink. The pumping mechanism has an inlet and an outlet. The switching valve switches the inlet of the pumping mechanism between communication with the first flow channel and with the second flow channel. The third flow channel allows communication between the outlet of the pumping mechanism and the recording head. The switching valve switches the inlet of the pumping mechanism to communication with the first flow channel so that the pumping mechanism supplies the replacement assisting liquid from the first tank to the recording head. The switching valve switches the inlet of the pumping mechanism to communication with the second flow channel so that the pumping mechanism supplies the ink from the second tank to the recording head.

DETAILED DESCRIPTION

Figure 1:
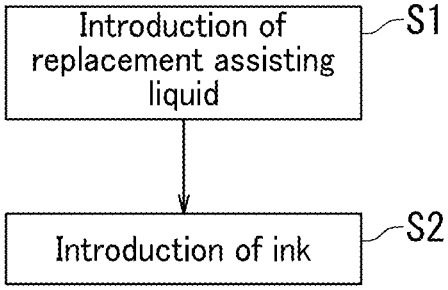
FIG. 1 shows a flow of an ink introduction method according to an embodiment of the present disclosure.

Hereinafter, embodiments of the present disclosure will be described with reference to the accompanying drawings. However, the present disclosure is not limited to the following embodiments. Elements in the drawings that are the same or equivalent are labelled using the same reference signs and explanation thereof is not repeated.

FIG. 1 shows a flow of an ink introduction method according to the present embodiment. The ink introduction method of the present embodiment uses a preservative solution and a replacement assisting liquid. The preservative solution contains at least a moisturizing agent. The replacement assisting liquid has a lower specific weight than the ink.

First, in the ink introduction method of the present embodiment, the replacement assisting liquid is introduced into a flow channel within a recording head filled with the preservative solution (Step S1) as shown in FIG. 1. At the same time, the preservative solution is discharged from the recording head. That is, the preservative solution in the recording head is replaced with the replacement assisting liquid. Next, the ink is introduced into the flow channel within the recording head (Step S2). At the same time, the replacement assisting liquid is discharged from the recording head. That is, the replacement assisting liquid in the recording head is replaced with the ink.

According to the ink introduction method of the present embodiment, the flow channel within the recording head can be filled with the preservative solution containing a moisturizing agent for transport, storage, or distribution of the recording head or an inkjet recording apparatus including the recording head. It is therefore possible to prevent freezing of the preservative solution in the recording head during transport, storage, or distribution of the recording head or the inkjet recording apparatus in colder climates. Accordingly, it is possible to prevent a fine structure or a fine feature of the recording head such as a flow channel having a fine step and a fine gap from being damaged. In the case of a piezoelectric inkjet recording head, the piezoelectric element thereof can be prevented from being damaged.

Furthermore, according to the ink introduction method of the present embodiment, the recording head can be filled with the replacement assisting liquid having a lower specific weight than the ink prior to the ink introduction. Accordingly, the ink diffuses well in the flow channel within the recording head. As a result, the ink introduction into the recording head is facilitated. In other words, ink loading into the recording head is facilitated.

According to the ink introduction method of the present embodiment, therefore, both the function of preventing freezing of the preservative solution and the function of facilitating ink introduction into the recording head are achieved.

Preferably, the ink is introduced after a predetermined period of time from the introduction of the replacement assisting liquid, for example, after one hour. This is because a small amount of preservative solution may remain in the recording head after the introduction of the replacement assisting liquid. The small amount of preservative solution remaining in the recording head diffuses in the replacement assisting liquid during the predetermined period of time from the introduction of the replacement assisting liquid. Thus, the ink can be introduced into the flow channel with the remaining preservative solution diluted.

Figure 2:
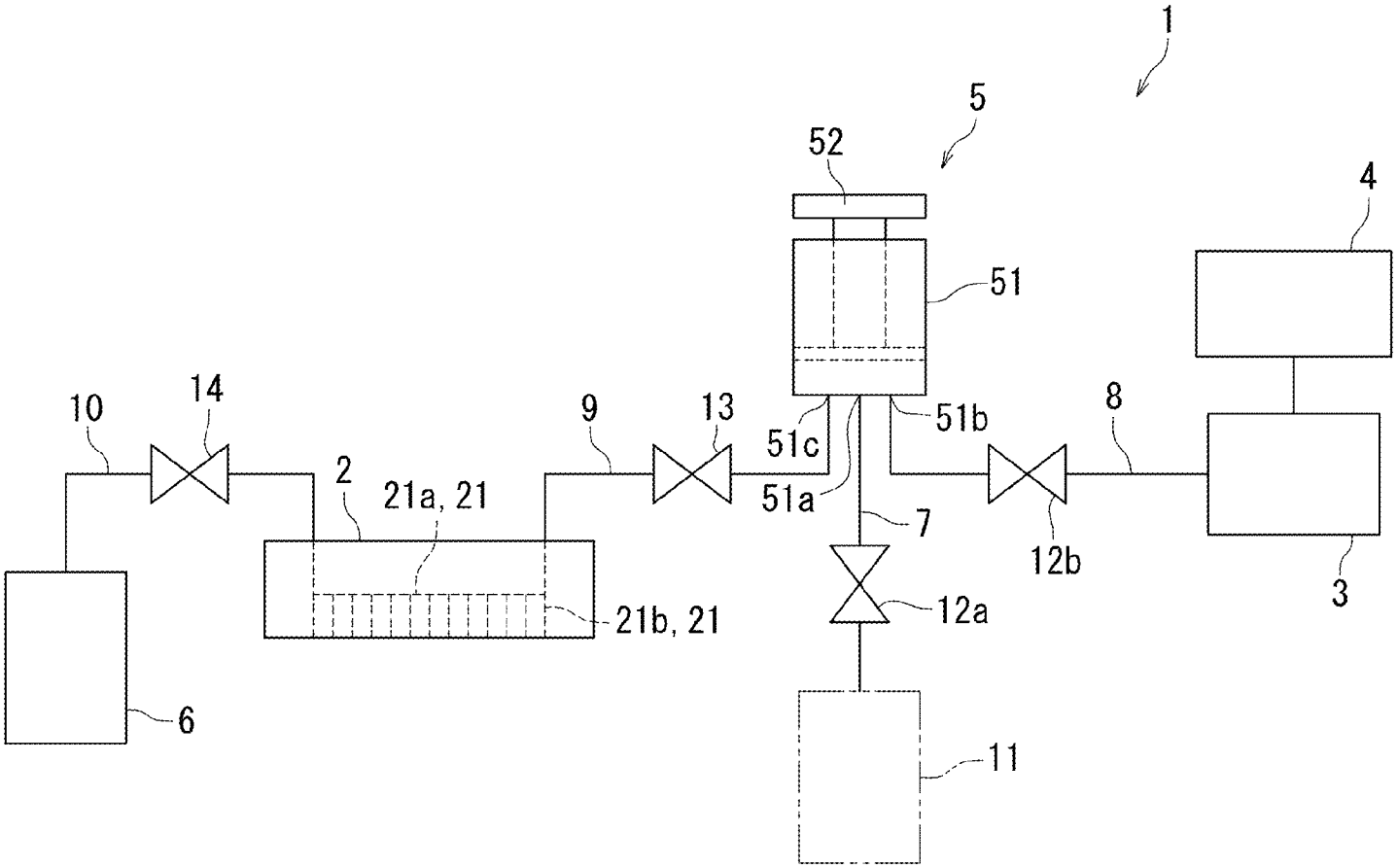
FIG. 2 is a diagram illustrating configuration of an inkjet recording apparatus according to the embodiment of the present disclosure.
Figure 3:
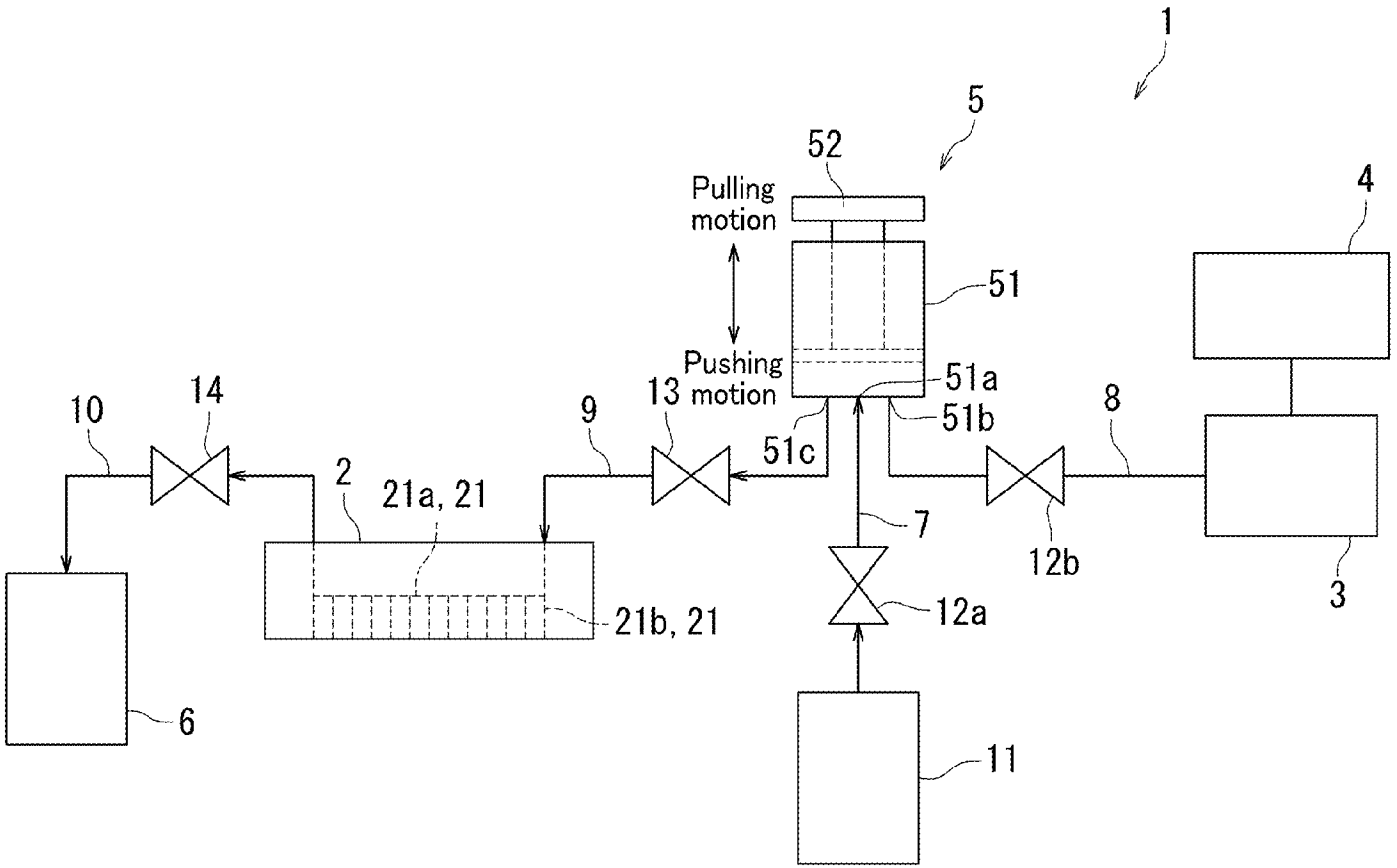
FIG. 3 is a diagram illustrating a first operation of the inkjet recording apparatus according to the embodiment of the present disclosure.

Next, an inkjet recording apparatus 1 of the present embodiment will be described with reference to FIGS. 2 to 4. FIG. 2 is a diagram illustrating configuration of the inkjet recording apparatus 1.

As illustrated in FIG. 2, the inkjet recording apparatus 1 includes a recording head 2, an ink tank 3, an ink pack 4, a pumping mechanism 5, and a waste solution tank 6. The inkjet recording apparatus 1 also includes a first flow channel 7, a second flow channel 8, a third flow channel 9, and a fourth flow channel 10. The inkjet recording apparatus 1 further includes four solenoid valves (a first solenoid valve 12*a*, a second solenoid valve 12*b*, a third solenoid valve 13, and a fourth solenoid valve 14).

A fine flow channel 21 is formed within the recording head 2. More specifically, the fine flow channel 21 includes a common flow channel 21*a* and a branched channel 21*b*. The common flow channel 21*a* extends from an inlet to an outlet of the fine flow channel 21. The branched channel 21*b* includes flow channels each branched downward from the common flow channel 21*a* and extending to each of nozzles. The recording head 2 may be of any type. The recording head 2 may be a piezoelectric inkjet recording head, a thermal inkjet recording head, or a continuous inkjet recording head.

The ink tank 3 contains an ink. The ink tank 3 is connected with the ink pack 4. The ink contained in the ink pack 4 is supplied to the ink tank 3 as appropriate.

The pumping mechanism 5 includes a hollow cylinder 51 and a piston 52. A part of the piston 52 is inserted into a hollow part of the cylinder 51. The piston 52 can be moved in a longitudinal direction of the cylinder 51 by a drive device (not shown). In the present embodiment, two inlets (a first inlet 51*a* and a second inlet 51*b*) and an outlet 51*c* are formed in a bottom of the cylinder 51.

The inkjet recording apparatus 1 has a configuration in which a tank 11 (an example of the first tank) that contains the replacement assisting liquid can be connected with one end of the first flow channel 7, and the other end of the first flow channel 7 is connected with the first inlet 51*a* of the pumping mechanism 5. The first solenoid valve 12*a* (an example of the switching valve) is provided in the first flow channel 7.

One end of the second flow channel 8 is connected with the ink tank 3 (an example of the second tank), and the other end of the second flow channel 8 is connected with the second inlet 51*b* of the pumping mechanism 5. The second solenoid valve 12*b* (an example of the switching valve) is provided in the second flow channel 8.

One end of the third flow channel 9 is connected with the outlet 51*c* of the pumping mechanism 5, and the other end of the third flow channel 9 is connected with the inlet of the fine flow channel 21 formed within the recording head 2, and particularly an inlet of the common flow channel 21*a*. The third solenoid valve 13 is provided in the third flow channel 9.

One end of the fourth flow channel 10 is connected with the outlet of the fine flow channel 21 formed within the recording head 2, and particularly an outlet of the common flow channel 21*a*. The other end of the fourth flow channel 10 is connected with the waste solution tank 6. The fourth solenoid valve 14 is provided in the fourth flow channel 10.

Next, an ink introduction method performed in the inkjet recording apparatus 1 will be described with reference to FIGS. 3 and 4. FIG. 3 is a diagram illustrating a first operation of the inkjet recording apparatus 1 in ink introduction. FIG. 4 is a diagram illustrating a second operation of the inkjet recording apparatus 1 in ink introduction.

Prior to the ink introduction, the fine flow channel 21 formed within the recording head 2 is filled with the preservative solution. In introducing an ink into the recording head 2, first, the tank 11 is connected with the one end of the first flow channel 7 as illustrated in FIG. 3. The tank 11 contains the replacement assisting liquid. For example, a service technician connects the tank 11 with the one end of the first flow channel 7. Thereafter, the replacement assisting liquid is introduced into the recording head 2. Specifically, the replacement assisting liquid is introduced into the fine flow channel 21.

More specifically, first, the piston 52 of the pumping mechanism 5 is pulled with the first solenoid valve 12*a* open, and the second, third, and fourth solenoid valves 12*b*, 13, and 14 closed. The pulling motion of the piston 52 causes the replacement assisting liquid contained in the tank 11 to be drawn into the cylinder 51 of the pumping mechanism 5 through the first flow channel 7.

Next, the first solenoid valve 12*a* is closed, and the third and fourth solenoid valves 13 and 14 are opened. As a result, the cylinder 51 comes in communication with the inlet of the fine flow channel 21 formed within the recording head 2. At the same time, the waste solution tank 6 comes in communication with the outlet of the fine flow channel 21. In the state described above, the piston 52 is pushed. The pushing motion of the piston 52 causes the replacement assisting liquid in the cylinder 51 to be introduced into the fine flow channel 21 through the third flow channel 9. At the same time, the preservative solution is discharged from the outlet of the fine flow channel 21 into the waste solution tank 6 through the fourth flow channel 10.

The operation described above is performed at least once in order to introduce the replacement assisting liquid into the recording head 2. That is, the preservative solution in the recording head 2 is replaced with the replacement assisting liquid. After completion of the replacement, the ink is introduced into the fine flow channel 21 formed within the recording head 2.

Figure 4:
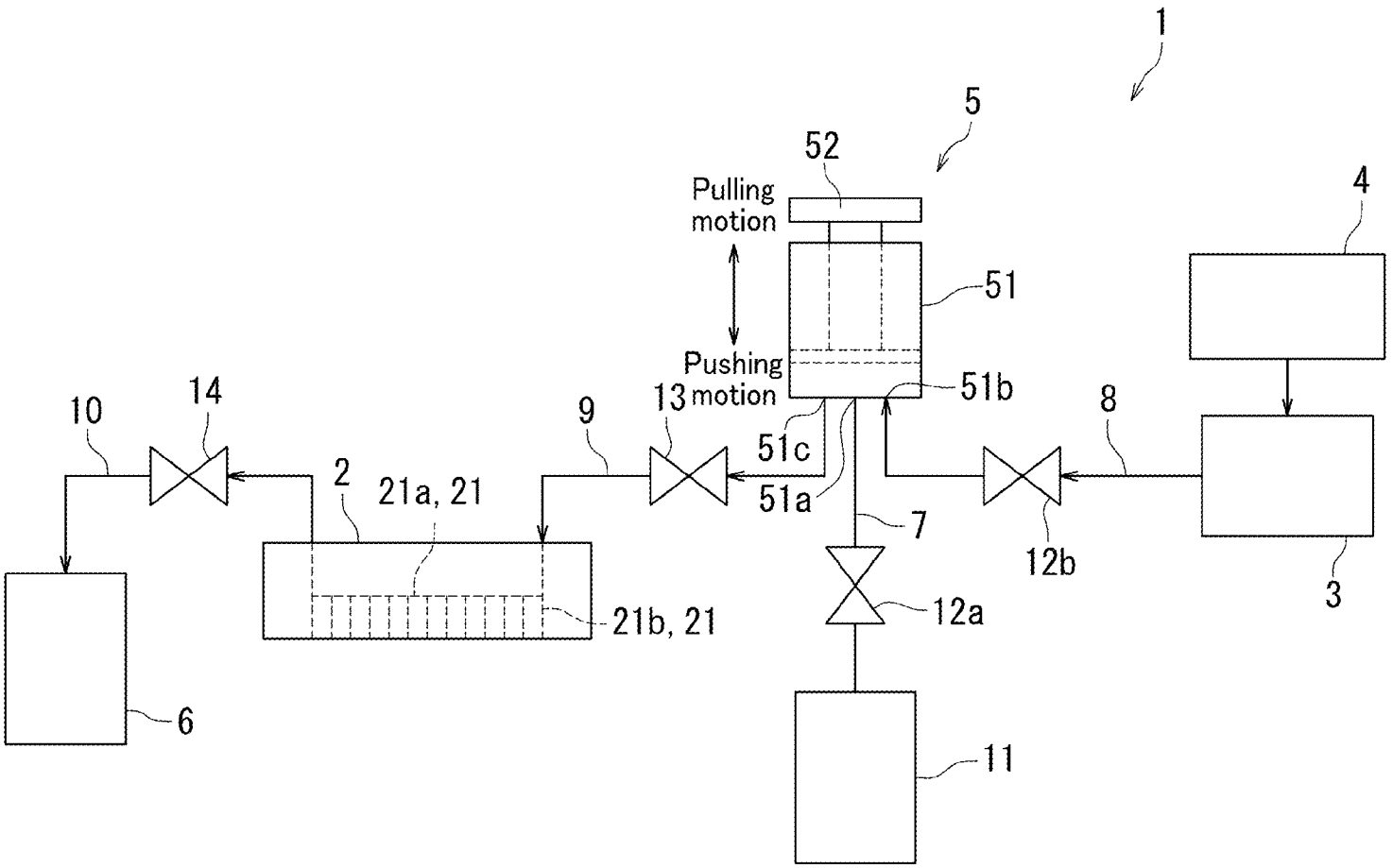
FIG. 4 is a diagram illustrating the second operation of the inkjet recording apparatus according to the embodiment of the present disclosure.

More specifically, first, the piston 52 of the pumping mechanism 5 is pulled with the second solenoid valve 12*b* open, and the first, third, and fourth solenoid valves 12*a*, 13, and 14 closed as illustrated in FIG. 4. The pulling motion of the piston 52 causes the ink contained in the ink tank 3 to be drawn into the cylinder 51 of the pumping mechanism 5 through the second flow channel 8.

Next, the second solenoid valve 12*b* is closed, and the third and fourth solenoid valves 13 and 14 are opened. As a result, the cylinder 51 comes in communication with the inlet of the fine flow channel 21 formed within the recording head 2. At the same time, the waste solution tank 6 comes in communication with the outlet of the fine flow channel 21. In the state described above, the piston 52 is pushed. The pushing motion of the piston 52 causes the ink in the cylinder 51 to be introduced into the fine flow channel 21 through the third flow channel 9. At the same time, the replacement assisting liquid is discharged from the outlet of the fine flow channel 21 into the waste solution tank 6 through the fourth flow channel 10.

The operation described above is performed at least once in order to introduce the ink into the recording head 2. As a result, the replacement assisting liquid in the recording head 2 is replaced with the ink. Note that the tank 11 may be detached from the inkjet recording apparatus 1 after the ink has been introduced into the recording head 2.

As described above, the inkjet recording apparatus 1 of the present embodiment has a configuration in which the tank 11 that contains the replacement assisting liquid can be attached to the one end of the first flow channel 7. The first and second solenoid valves 12*a* and 12*b* (switching valves) switch the pumping mechanism 5 between communication with the first flow channel 7 and with the second flow channel 8. More specifically, the cylinder 51 is switched between communication with the first flow channel 7 and with the second flow channel 8. Accordingly, operating the pumping mechanism 5, that is, operating the piston 52 with the first solenoid valve 12*a* open and the second solenoid valve 12*b* closed enables supplying the replacement assisting liquid from the tank 11 to the recording head 2 (fine flow channel 21). Operating the pumping mechanism 5 (piston 52) with the first solenoid valve 12*a* closed and the second solenoid valve 12*b* open enables supplying the ink from the ink tank 3 to the recording head 2 (fine flow channel 21).

The inkjet recording apparatus 1 of the present embodiment can therefore implement the ink introduction method described with reference to FIG. 1. That is, the recording head 2 is filled with the replacement assisting liquid having a lower specific weight than the ink prior to the ink introduction. The ink therefore diffuses well in the fine flow channel 21 formed within the recording head 2. Thus, the ink introduction into the recording head 2 is facilitated. In other words, ink loading into the recording head 2 is facilitated.

Next, the preservative solution that is used in the ink introduction method of the present embodiment will be described. The preservative solution is loaded in a flow channel (fine flow channel) formed within a recording head at a production site such as a factory.

The preservative solution contains at least a moisturizing agent. The moisturizing agent imparts the antifreezing function to the preservative solution. The moisturizing agent is not particularly limited so long as the agent is a material that is resistant to freezing in low-temperature environments. For example, glycerin may be used as the moisturizing agent.

The moisturizing agent content in the preservative solution is not definitively limited and may vary depending on low-temperature resistance desired for the preservative solution, the composition of the preservative solution, the type of the moisturizing agent, and so on. For example, the preservative solution may contain the moisturizing agent in an amount of no less than 30% by mass and no greater than 60% by mass relative to the mass of the preservative solution. The moisturizing agent contained in an amount of no less than 30% by mass and no greater than 60% by mass prevents freezing of the preservative solution in low-temperature environments, for example, at an atmospheric temperature of −20° C. The preservative solution may for example contain water in order to adjust the moisturizing agent concentration.

The preservative solution preferably contains a surfactant and a compatibilizing agent in addition to the moisturizing agent. A preservative solution containing a surfactant shows good wetting and spreading characteristics in the flow channel formed within the recording head. A preservative solution containing a compatibilizing agent tends to not experience inhomogeneous mixing of the components thereof such as water, the moisturizing agent, the surfactant, and the compatibilizing agent.

The surfactant content in the preservative solution is not definitively limited and may vary depending on wetting and spreading characteristics desired for the preservative solution, the composition of the preservative solution, the type of the surfactant, and so on. For example, the preservative solution may contain the surfactant in an amount of greater than 0% by mass and no greater than 2% by mass relative to the mass of the preservative solution. The surfactant contained in an amount of no greater than 2% by mass ensures sufficient wetting and spreading characteristics of the preservative solution in the flow channel formed within the recording head.

The compatibilizing agent content in the preservative solution is not definitively limited and may vary depending on the composition of the preservative solution, the type of the compatibilizing agent, and so on. For example, the preservative solution may contain the compatibilizing agent in an amount of greater than 0% by mass and no greater than 10% by mass relative to the mass of the preservative solution. The compatibilizing agent contained in an amount of no greater than 10% by mass reduces the possibility of inhomogeneous mixing of the components of the preservative solution. The higher the compatibilizing agent content in the preservative solution is, the higher the compatibility between the components of the preservative solution is.

The surfactant may be of any type so long as the surfactant is capable of ensuring sufficient wetting and spreading characteristics of the preservative solution in the flow channel formed within the recording head. However, the inventors have made intensive studies to find that it is favorable to add an acrylic acid-based copolymer having an acid value of no less than 30 and no greater than 130 as the surfactant to the preservative solution in the case where the ink is a pigment-based ink.

More specifically, the inventors have found that diluting a pigment-based ink with a generic preservative solution causes aggregation of a pigment, which is an example of the coloring component, in the ink. The phenomenon described above is referred to as solvent shock. The inventors have then found that the phenomenon (pigment aggregation) is attributable to the surfactant contained in the preservative solution. More specifically, the inventors have found that diluting a pigment-based ink with a preservative solution containing an acetylene glycol-based surfactant causes a pigment dispersion contained in the ink to aggregate rather than stably dispersing in the preservative solution, resulting in pigment aggregation.

The inventors have therefore studied surfactants and found an acrylic acid-based copolymer having an acid value of no less than 30 and no greater than 130 to be a surfactant that can ensure both the good wetting and spreading characteristics of the preservative solution in the flow channel formed within the recording head and the prevention of pigment (coloring component) aggregation.

In the ink introduction method of the present embodiment, the preservative solution is replaced with the replacement assisting liquid prior to the ink introduction. However, a small amount of preservative solution may remain in the recording head after the introduction of the replacement assisting liquid. In the case of a surfactant-containing preservative solution, therefore, the preservative solution remaining in the recording head may cause aggregation of a coloring component in the ink.

Therefore, the preservative solution preferably contains an acrylic acid-based copolymer having an acid value of no less than 30 and no greater than 130 as a surfactant in the case where the ink is a pigment-based ink. That is, addition of an acrylic acid-based copolymer having an acid value of no less than 30 and no greater than 130 to the preservative solution allows imparting of the wetting and spreading characteristics to the preservative solution and prevention of pigment (coloring component) aggregation.

The compatibilizing agent is not particularly limited so long as the agent is a material that prevents inhomogeneous mixing of the components of the preservative solution. For example, 2-pyrrolidone may be used as the compatibilizing agent.

Next, the replacement assisting liquid that is used in the ink introduction method of the present embodiment will be described. The replacement assisting liquid may be any material that has a lower specific weight than the ink, and examples thereof include water. Since the replacement assisting liquid has a lower specific weight than the ink, satisfactory introduction and diffusion of the ink in the flow channel (fine flow channel) formed within the recording head is ensured.

Like the preservative solution, the replacement assisting liquid preferably contains a surfactant. The replacement assisting liquid containing a surfactant shows good wetting and spreading characteristics in the flow channel formed within the recording head. The replacement assisting liquid preferably contains an acrylic acid-based copolymer having an acid value of no less than 30 and no greater than 130 as the surfactant in the case where the ink is a pigment-based ink. That is, addition of an acrylic acid-based copolymer having an acid value of no less than 30 and no greater than 130 to the replacement assisting liquid allows imparting of the wetting and spreading characteristics to the replacement assisting liquid and prevention of pigment (coloring component) aggregation.

The surfactant content in the replacement assisting liquid is not definitively limited and may vary depending on wetting and spreading characteristics desired for the replacement assisting liquid, the composition of the replacement assisting liquid, the type of the surfactant, and so on. For example, the replacement assisting liquid may contain the surfactant in an amount of greater than 0% by mass and no greater than 2% by mass relative to the mass of the replacement assisting liquid. The surfactant contained in an amount of no greater than 2% by mass ensures sufficient wetting and spreading characteristics of the replacement assisting liquid in the flow channel formed within the recording head.

Like the preservative solution, the replacement assisting liquid preferably contains a moisturizing agent. The moisturizing agent imparts the antifreezing function to the replacement assisting liquid. The moisturizing agent is not particularly limited so long as the agent is a material that is resistant to freezing in low-temperature environments. For example, glycerin may be used as the moisturizing agent.

The moisturizing agent content in the replacement assisting liquid is not definitively limited and may vary depending on low temperature resistance desired for the replacement assisting liquid, the composition of the replacement assisting liquid, the type of the moisturizing agent, and so on. In the present embodiment, however, the replacement assisting liquid needs to have a lower specific weight than the ink. The specific weight of the ink is therefore a factor determining the moisturizing agent content in the replacement assisting liquid. For example, the replacement assisting liquid may contain the moisturizing agent in an amount of greater than 0% by mass and no greater than 20% by mass relative to the mass of the replacement assisting liquid.

Like the preservative solution, the replacement assisting liquid preferably contains a compatibilizing agent. A replacement assisting liquid containing a compatibilizing agent tends to not experience inhomogeneous mixing of the components thereof such as water, the moisturizing agent, the surfactant, and the compatibilizing agent.

The compatibilizing agent is not particularly limited so long as the agent is a material that prevents inhomogeneous mixing of the components of the replacement assisting liquid. For example, 2-pyrrolidone may be used as the compatibilizing agent.

The compatibilizing agent content in the replacement assisting liquid is not definitively limited and may vary depending on the composition of the replacement assisting liquid, the type of the compatibilizing agent, and so on. For example, the replacement assisting liquid may contain the compatibilizing agent in an amount of greater than 0% by mass and no greater than 10% by mass relative to the mass of the replacement assisting liquid. The compatibilizing agent contained in an amount of no greater than 10% by mass reduces the possibility of inhomogeneous mixing of the components of the replacement assisting liquid. As in the preservative solution, the higher the compatibilizing agent content in the replacement assisting liquid is, the higher the compatibility between the components of the replacement assisting liquid is.

The moisturizing agent has a relatively high specific weight. Including a smaller amount of moisturizing agent in the replacement assisting liquid than an amount of moisturizing agent in the preservative solution therefore allows the replacement assisting liquid to have a lower specific weight than the ink. In this case, however, the replacement assisting liquid is less resistant to freezing than the preservative solution. It is therefore preferable to contain the replacement assisting liquid in a container that protects its content from influences of the surrounding environment, and particularly a container that is less susceptible to atmospheric temperature or room temperature. For example, the replacement assisting liquid is desirably contained in a well-closed container. Thus, the amount of the moisturizing agent in the replacement assisting liquid can be smaller than the amount of the moisturizing agent in the preservative solution.

According to the present embodiment, as described above, a recording head is filled with the preservative solution having an excellent antifreezing property and having a relatively high specific weight for transport, storage, and distribution. In ink introduction, the replacement assisting liquid having a relatively low specific weight is first introduced into the recording head, and the preservative solution is discharged out of the recording head. Then, the ink is introduced into the recording head, and the replacement assisting liquid is discharged out of the recording head. Since the replacement assisting liquid has a lower specific weight, the ink diffuses well in the replacement assisting liquid. Thus, both the function of preventing freezing of the preservative solution and the function of facilitating ink introduction into the recording head can be achieved.

The inventors have found that in the case where the ink is a pigment-based ink, a surfactant causes aggregation of the pigment (coloring component) in the ink. The inventors have therefore studied surfactants and found that in the case where the ink is a pigment-based ink, use of an acrylic acid-based copolymer having an acid value of no less than 30 and no greater than 130 as a surfactant can ensure both the prevention of pigment aggregation and the good wetting and spreading characteristics of the preservative solution and the replacement assisting liquid. As a result, the inventors have arrived at the use of the acrylic acid-based copolymer having an acid value of no less than 30 and no greater than 130 as a surfactant to be added to the preservative solution and the replacement assisting liquid in the case where the ink is a pigment-based ink. According to the present embodiment, therefore, it is possible to achieve all of the function of preventing freezing of the preservative solution, the function of facilitating ink introduction into the recording head, and the function of preventing aggregation of the pigment (coloring component) by selecting a specific surfactant, even in the case where the ink is a pigment-based ink.

One of the embodiments of the present disclosure has been described so far. However, the present disclosure is not limited to the above-described embodiment and can be practiced in various ways within the scope without departing from the essence of the present disclosure.

For example, the present disclosure is not limited to the configuration of the inkjet recording apparatus 1 described with reference to FIGS. 2 to 4 in which two solenoid valves (the first solenoid valve 12*a* and the second solenoid valve 12*b*) are used as the switching valve for switching the pumping mechanism 5 between communication with the first flow channel 7 and with the second flow channel 8. One three-way valve may be used as the switching valve for switching the pumping mechanism 5 between communication with the first flow channel 7 and with the second flow channel 8. In this configuration, the pumping mechanism 5 has one inlet.

For another example, the present disclosure is not limited to the configuration of the inkjet recording apparatus 1 described with reference to FIGS. 2 to 4 in which the preservative solution and the replacement assisting liquid are discharged from the outlet of the fine flow channel 21 formed within the recording head 2 to the waste solution tank 6. For example, the preservative solution and the replacement assisting liquid may be discharged to a tray 15 as illustrated in FIG. 5.

Figure 5:
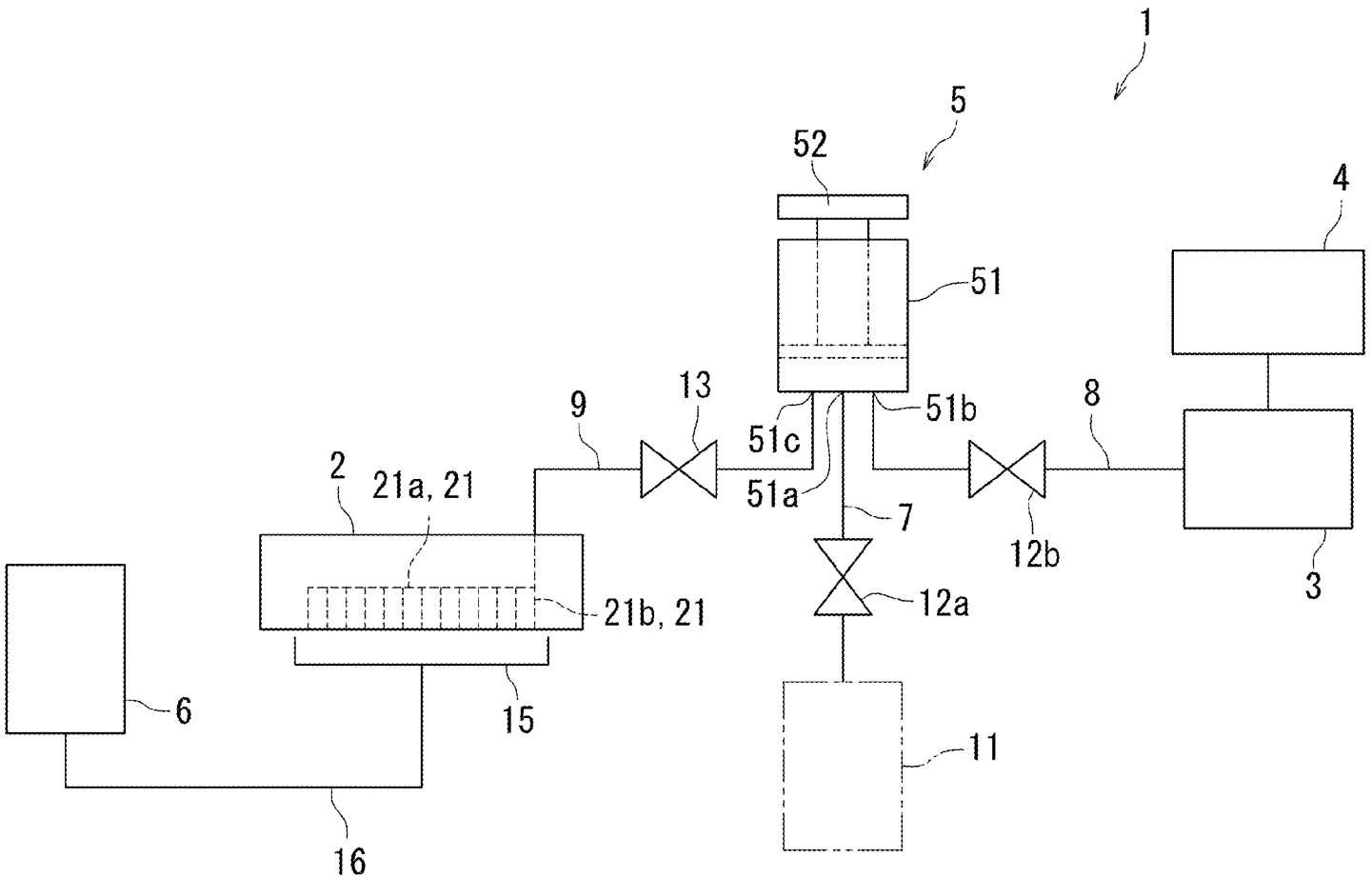
FIG. 5 is a diagram illustrating configuration of an inkjet recording apparatus according to another embodiment of the present disclosure.

FIG. 5 is a configuration of an inkjet recording apparatus 1 according to another embodiment. As illustrated in FIG. 5, the inkjet recording apparatus 1 according to the present embodiment is different from the inkjet recording apparatus 1 illustrated in FIG. 2 in that the former includes the tray 15 and a fifth flow channel 16 instead of the fourth flow channel 10 and the fourth solenoid valve 14. Furthermore, unlike the inkjet recording apparatus 1 illustrated in FIG. 2, the inkjet recording apparatus 1 of the present embodiment does not have an outlet in the recording head 2. In other words, the fine flow channel 21 formed within the recording head 2 includes only a flow channel extending from the inlet of the fine flow channel 21 to each nozzle.

The inkjet recording apparatus 1 includes a mechanism (not shown) for moving the tray 15 in a horizontal direction. The tray 15 is located opposite to a lower surface of the recording head 2 when the preservative solution is discharged from the recording head 2. Likewise, the tray 15 is located opposite to the lower surface of the recording head 2 when the replacement assisting liquid is discharged from the recording head 2. The fifth flow channel 16 allows communication between the tray 15 and the waste solution tank 6.

According to the configuration, the preservative solution can be discharged to the tray 15 through each nozzle of the recording head 2 in the introduction of the replacement assisting liquid. The preservative solution discharged to the tray 15 is collected in the waste solution tank 6 through the fifth flow channel 16. According to the configuration, the replacement assisting liquid can also be discharged to the tray 15 through each nozzle of the recording head 2 in the introduction of the ink. The replacement assisting liquid discharged to the tray 15 is collected in the waste solution tank 6 through the fifth flow channel 16.

Examples

Hereinafter, examples of the present disclosure will be provided. However, the present disclosure is not limited thereto.

[Evaluation of Aggregation Preventing Function]

Solutions No. 1 to No. 7 having compositions shown in Table 1 and a water-based pigmented ink No. 8 having a composition shown in Table 2 were prepared.

TABLE 1

| | | Specific weight (g/cc) | Composition ratio (wt %) | | | | |
|---|---|---|---|---|---|---|---|
| | | | | | Surfactant | | |
| | | | Water | 2-pyrrolidone | Acetylene glycol | Acrylic acid-based (acid value: 130) | Glycerin |
| No. 1 | Comparative Example | 1.033 | 84% | 5% | 1% | | 10% |
| No. 2 | Replacement | 1.033 | 84% | 5% | | 1% | 10% |
| No. 3 | assisting | 1.059 | 74% | 5% | | 1% | 20% |
| No. 4 | liquid | 1.085 | 64% | 5% | | 1% | 30% |
| No. 5 | Preservative | 1.111 | 54% | 5% | | 1% | 40% |
| No. 6 | solution | 1.137 | 44% | 5% | | 1% | 50% |
| No. 7 | | 1.163 | 34% | 5% | | 1% | 60% |
| No. 8 | Water-based pigment ink | 1.04-1.06 | | | | | |

TABLE 2

| Ink composition | |
|---|---|
| Ink materials | Content (% by mass) |
| Water | 57.15% |
| Pigment dispersion | 7.00% |
| KL-800 | 0.15% |

TABLE 2-continued

| Ink composition | |
|---|---|
| Ink materials | Content (% by mass) |
| 2-pyrrolidone | 7.00% |
| Glycerin | 8.00% |
| 1,3-propanediol | 14.00% |
| Triethylene glycol monobutyl ether | 6.00% |
| 1,2-octanediol | 0.70% |
| Total | 100.00% |

The solution No. 1 in Table 1 is a generic preservative solution. That is, the solution No. 1 is a preservative solution that is loaded in a recording head for transport of the recording head and that is replaced directly with an ink in ink introduction. Herein, the solution No. 1 was prepared as a comparative example. The solutions No. 2 to No. 4 are examples of the replacement assisting liquid according to the present disclosure. The solutions No. 5 to No. 7 are examples of the preservative solution according to the present disclosure. The "Acrylic acid-based (acid value: 130)" in Table 1 means an acrylic acid-based copolymer having an acid value of 130. Table 1 shows the specific weight of each of the solutions No. 1 to No. 7 and the water-based pigment ink No. 8.

In Table 2, the water content, the 2-pyrrolidone content, and so on take account of water, 2-pyrrolidone, and so on contained in the pigment dispersion. The pigment dispersion content refers to a content of a pigment having a surface coated with a resin. Phthalocyanine Blue 15:3 ("Lionol Blue FG-7330", product by TOYOCOLOR CO., LTD.), which is an example of a cyan pigment, was used as a pigment. A styrene-acrylic acid-based resin was synthesized by macromonomer synthesis using styrene, acrylic acid, butyl acrylate, and methyl methacrylate. Then, the surface of the pigment (Phthalocyanine Blue 15:3) was coated with the styrene-acrylic acid-based resin to water-solubilize the pigment. The mass average molecular weight (Mw) of the styrene-acrylic acid-based resin was measured under the following conditions using a gel filtration chromatography system (HLC-8020 GPC, product by Tosoh Corporation) to be approximately 33,000. The acid value (mgKOH/g) of the styrene-acrylic acid-based resin was measured by titration to be 150.

<Conditions for Measurement of Mass Average Molecular Weight>

Column: TSKgel, Super Multipore HZ-H (product by Tosoh Corporation, 4.6 mm ID×15 cm)

Number of columns: 3

Eluent: tetrahydrofuran

Flow rate: 0.35 mL/minute

Sample amount: 10 μL

Measurement temperature: 40° C.

Detector: IR detector

A calibration curve was prepared using standard samples (TSK standard, polystyrene, product by Tosoh Corporation) of the following eight types: F-40, F-20, F-4, F-1, A-5000, A-2500, A-1000, and n-propylbenzene.

Each of the solutions No. 1 to No. 7 prepared was poured in a sample jar (9.5 mL), and 0.01 mg of the water-based pigment ink No. 8 was added dropwise to each of the solutions No. 1 to No. 7 contained in the respective sample jars. The sample jars were stored at an ambient temperature of 60° C. for three days, and then the presence or absence of aggregation of the ink (aggregation of the pigment) (aggregation preventing function of the solutions No. 1 to No. 7) was visually evaluated. The evaluation results are shown in Table 3. In the aggregation preventing function evaluation results shown in Table 3, "G" indicates that ink aggregation was not observed, and "P" indicates that ink aggregation was observed.

TABLE 3

| | Aggregation preventing function | Introduction and diffusion facilitating function | Antifreezing function |
|---|---|---|---|
| No. 1 Comparative Example | P | A | A |
| No. 2 Replacement | G | G | P |
| No. 3 assisting | G | G | P |
| No. 4 liquid | G | A | A |
| No. 5 Preservative | G | P | G |
| No. 6 solution | G | P | G |
| No. 7 | G | P | G |

[Evaluation of Introduction and Diffusion Facilitating Function]

Solutions No. 1 to No. 7 having compositions shown in Table 1 and a water-based pigment ink No. 8 having a composition shown in Table 2 were prepared. Each of the solutions No. 1 to No. 7 was poured in a sample jar (9.5 mL). Next, 0.01 mg of the water-based pigment ink No. 8 was added dropwise to each of the solutions No. 1 to No. 7 contained in the respective sample jars. One minute later, the diffusivity of the ink (the introduction and diffusion facilitating function of the solutions No. 1 to No. 7) was visually evaluated. The evaluation results are shown in Table 3. In the introduction and diffusion facilitating function evaluation results shown in Table 3, "G" indicates that the ink diffused substantially throughout the sample jar, and "P" indicates that the ink did not diffuse at all. In addition, "A" indicates that the ink diffused over a portion of the sample jar.

Figure 6A:
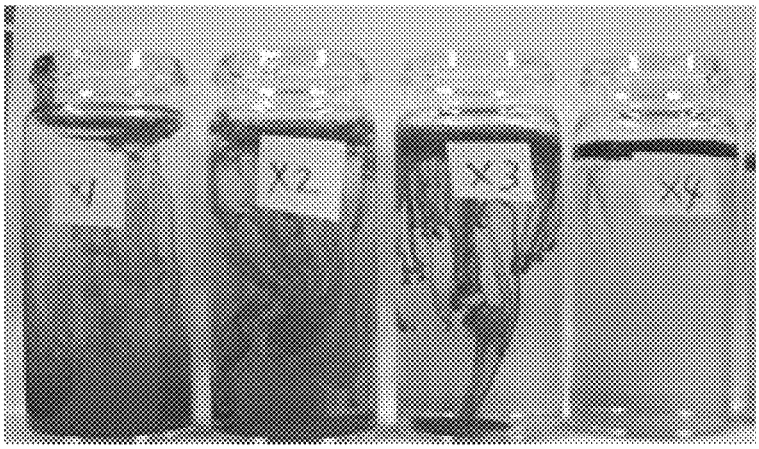
FIGS. 6A and 6B are photographic images of sample jars according to examples of the present disclosure that were captured in introduction and diffusion facilitating function evaluation.
Figure 6B:
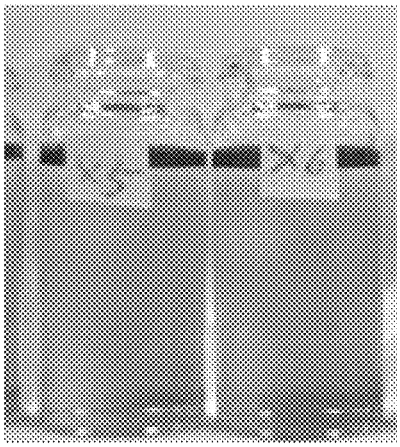

FIGS. 6A and 6B are photographic images of some of the sample jars containing the replacement assisting liquids No. 2 to No. 4 and the preservative solutions No. 5 to No. 7, respectively. The photographs were captured in the introduction and diffusion facilitating function evaluation of the solutions No. 1 to No. 7. In FIGS. 6A and 6B, the sample jar with a sticker thereon reading "X1" corresponds to the sample jar containing the replacement assisting liquid No. 2. The sample jars with stickers thereon reading "X2", "X3", "X4", "X5", and "X6" correspond to the sample jars containing the replacement assisting liquids No. 3 and No. 4, and the preservative solutions No. 5, No. 6, and No. 7, respectively. As shown in FIGS. 6A and 6B, the ink diffused substantially throughout each of the sample jars containing the replacement assisting liquids No. 2 and No. 3 whose introduction and diffusion facilitating functions were evaluated as "G" (sample jars X1 and X2). The ink diffused over a portion of the sample jar containing the replacement assisting liquid No. 4 whose introduction and diffusion facilitating function was evaluated as "A" (sample jar X3). The ink did not diffuse at all in the sample jars containing the preservative solutions No. 5 to No. 7 whose introduction and diffusion facilitating functions were evaluated as "P" (sample jars X4 to X6).

[Evaluation of Antifreezing Function]

Solutions No. 1 to No. 7 each having compositions shown in Table 1 were prepared, and each of the solutions No. 1 to No. 7 was poured in a sample jar (9.5 mL). The sample jars were stored at an ambient temperature of −20° C. for one day, and freezing (the antifreezing function of the solutions No. 1 to No. 7) of each of the solutions No. 1 to No. 7 was visually evaluated. The evaluation results are shown in Table 3. In the antifreezing function evaluation results shown in Table 3, "G" indicates that the solution was liquiform, having fluidity. "P" indicates that the solution was frozen hard. "A" indicates that the solution was slushy, having fluidity.

[Ink Introduction Evaluation 1]

A recording head (test sample) filled with the preservative solution No. 5 was stored at an ambient temperature of −20° C. for one day, and then returned to room temperature. Subsequently, the preservative solution No. 5 in the recording head was replaced with the replacement assisting liquid No. 2. One hour after completion of the replacement, the replacement assisting liquid No. 2 in the recording head was replaced with the water-based pigment ink No. 8. The time taken to replace the preservative solution No. 5 in the recording head with the replacement assisting liquid No. 2 was approximately five minutes. The time taken to replace the replacement assisting liquid No. 2 in the recording head with the water-based pigment ink No. 8 was approximately five minutes. That is, the ink was loaded (introduced) into the recording head readily.

[Ink Introduction Evaluation 2]

A recording head (test sample) filled with the preservative solution No. 7 was stored at an ambient temperature of −20° C. for one day, and then returned to room temperature. Subsequently, the preservative solution No. 7 in the recording head was replaced with the replacement assisting liquid No. 4. One hour after completion of the replacement, the replacement assisting liquid No. 4 in the recording head was replaced with the water-based pigment ink No. 8. The time taken to replace the preservative solution No. 7 in the recording head with the replacement assisting liquid No. 4 was approximately five minutes. The time taken to replace the replacement assisting liquid No. 4 in the recording head with the water-based pigment ink No. 8 was approximately five minutes. That is, the ink was loaded (introduced) into the recording head readily even in the case where the replacement assisting liquid No. 4 whose introduction and diffusion facilitating function was visually evaluated as "A" was used.

[Evaluation of Acid Value of Acrylic Acid-Based Copolymer]

Replacement assisting liquids No. 2 to No. 4 and preservative solutions No. 5 to No. 7 having the same compositions as those shown in Table 1 except for containing an acrylic acid-based copolymer having an acid value of 30 as the surfactant were prepared, and the aggregation preventing function of each of the solutions was visually evaluated in the same manner as described above (the same manner as in the aggregation preventing function evaluation). As a result, aggregation of the ink (aggregation of the pigment) was not observed even though the surfactant was changed from the acrylic acid-based copolymer having an acid value of 130 to the acrylic acid-based copolymer having an acid value of 30.

What is claimed is:

1. A method of introducing an ink, comprising: introducing a replacement assisting liquid into a recording head filled with a preservative solution to discharge the preservative solution out of the recording head, the replacement assisting liquid having a lower specific weight than the ink, the preservative solution containing at least a moisturizing agent and having a higher specific weight than the ink; and introducing the ink into the recording head to discharge the replacement assisting liquid out of the recording head after the replacement assisting liquid has been introduced into the recording head, wherein the preservative solution contains a surfactant in an amount of greater than 0% by mass and no greater than 2% by mass relative to the mass of the preservative solution, and wherein the surfactant in the preservative solution comprises an acrylic acid-based copolymer having an acid value of no less than 30 and no greater than 130.

2. The method according to claim 1, wherein the ink is introduced after a predetermined period of time from the introduction of the replacement assisting liquid.

3. The method according to claim 1, wherein the preservative solution contains the moisturizing agent in an amount of no less than 30% by mass and no greater than 60% by mass relative to the mass of the preservative solution.

4. The method according to claim 1, wherein the preservative solution contains a compatibilizing agent in an amount of greater than 0% by mass and no greater than 10% by mass relative to the mass of the preservative solution.

5. The method according to claim 1, wherein the replacement assisting liquid contains a moisturizing agent, and an amount of the moisturizing agent in the replacement assisting liquid is smaller than an amount of the moisturizing agent in the preservative solution.

6. The method according to claim 1, wherein the replacement assisting liquid contains a moisturizing agent in an amount of greater than 0% by mass and no greater than 20% by mass relative to the mass of the replacement assisting liquid.

7. The method according to claim 1, wherein the replacement assisting liquid contains a compatibilizing agent in an amount of greater than 0% by mass and no greater than 10% by mass relative to the mass of the replacement assisting liquid.

8. The method according to claim 1, wherein the replacement assisting liquid contains a surfactant in an amount of greater than 0% by mass and no greater than 2% by mass relative to the mass of the replacement assisting liquid.

9. The method according to claim 8, wherein the surfactant in the replacement assisting liquid comprises an acrylic acid-based copolymer having an acid value of no less than 30 and no greater than 130.

10. An inkjet recording apparatus comprising:

a first flow channel configured to be connected with a first tank containing a replacement assisting liquid having a lower specific weight than an ink;

a second flow channel configured to be connected with a second tank containing the ink;

a pumping mechanism having an inlet and an outlet;

a switching valve configured to switch the inlet of the pumping mechanism between communication with the first flow channel and with the second flow channel; a recording head; and a third flow channel configured to allow communication between the outlet of the pumping mechanism and the recording head, wherein the switching valve switches the inlet of the pumping mechanism to communication with the first flow channel so that the pumping mechanism supplies the replacement assisting liquid from the first tank to the recording head filled with a preservative solution to discharge the preservative solution out of the recording head while introducing the replacement assisting liquid into the recording head, the preservative solution containing at least a moisturizing agent and having a higher specific weight than the ink, and after the replacement assisting liquid has been supplied to the recording head, the switching valve switches the inlet of the pumping mechanism to communication with the second flow channel so that the pumping mechanism supplies the ink from the second tank to the recording head to discharge the replacement assisting liquid out of the recording head while introducing the ink into the recording head, wherein the preservative solution contains a surfactant in an amount of greater than 0% by mass and no greater than 2% by mass relative to the mass of the preservative solution, and wherein the surfactant in the preservative solution comprises an acrylic acid-based copolymer having an acid value of no less than 30 and no greater than 130.

* * * * *